US007340780B2

(12) United States Patent
Levy

(10) Patent No.: US 7,340,780 B2
(45) Date of Patent: Mar. 11, 2008

(54) SPORTS GARMENT

(76) Inventor: Edward M. Levy, 2538 Sparrowbush Ln, Manasquan, NJ (US) 08736-2211

( * ) Notice: Subject to any disclaimer, the term of this patent is extended or adjusted under 35 U.S.C. 154(b) by 174 days.

(21) Appl. No.: 11/106,206

(22) Filed: Apr. 14, 2005

(65) Prior Publication Data

US 2006/0230491 A1 Oct. 19, 2006

(51) Int. Cl.
*A41B 1/00* (2006.01)
*A41D 1/18* (2006.01)

(52) U.S. Cl. ..... 2/115; 2/116; 2/107; 2/117

(58) Field of Classification Search ..... 2/69, 2/115, 116, DIG. 1, 90, 103, 106, 117, 121, 2/122, 127, 107
See application file for complete search history.

(56) References Cited

U.S. PATENT DOCUMENTS 380,576 A * 4/1888 Ives ..... 2/51
681,955 A * 9/1901 Dey ..... 2/115
733,776 A * 7/1903 Warner ..... 2/115
1,111,626 A * 9/1914 Tothill ..... 2/115
1,259,234 A * 3/1918 Heath ..... 2/115
1,400,881 A * 12/1921 King ..... 2/115
1,522,499 A 1/1925 Corn
1,612,010 A * 12/1926 Gray ..... 2/115
1,804,068 A * 5/1931 Spiers ..... 2/115
2,111,361 A 3/1938 Engalson
2,133,601 A * 10/1938 Ward ..... 2/93
2,415,333 A * 2/1947 Breier ..... 2/117
2,511,977 A * 6/1950 Garrison ..... 2/77
2,721,328 A * 10/1955 Rosenbaum ..... 2/95
3,078,699 A * 2/1963 Huntley ..... 66/176
3,098,236 A * 7/1963 Bernfeld ..... 66/106
3,448,460 A * 6/1969 Frank ..... 2/74
3,761,962 A * 10/1973 Myers ..... 2/79
4,078,265 A * 3/1978 Condit ..... 2/115
4,100,622 A * 7/1978 Juelg, Jr. ..... 2/115
4,453,274 A * 6/1984 Allen ..... 2/102
4,809,626 A 3/1989 Tyner
4,937,883 A * 7/1990 Shirai ..... 2/115
4,949,402 A 8/1990 McCool et al.

(Continued)

FOREIGN PATENT DOCUMENTS

DE 3623583 A * 1/1988

(Continued)

OTHER PUBLICATIONS

Uniforms Express; www.uniformsexpress.com/pics/105_stanford_big.jpg; as of Dec. 16, 2006; p. 1.*

(Continued)

*Primary Examiner*—Gary L. Welch
*Assistant Examiner*—Jena A Sold
(74) *Attorney, Agent, or Firm*—Law Offices of Donald Cox, LLC

(57) ABSTRACT

A sports garment including a pullover shirt having inner and outer lower layers. The inner lower layer is almost always worn tucked into pants to provide comfort and support to the wearer. The outer lower layer may be worn outside of the pants to provide the wearer with a neat and trim appearance.

15 Claims, 12 Drawing Sheets

U.S. PATENT DOCUMENTS

| | | | | | |
|---|---|---|---|---|---|
| 4,987,610 | A | * | 1/1991 | Hunt | 2/46 |
| 5,090,060 | A | * | 2/1992 | Gates | 2/115 |
| 5,105,478 | A | * | 4/1992 | Pyc | 2/115 |
| 5,628,064 | A | * | 5/1997 | Chung | 2/70 |
| 5,701,712 | A | | 12/1997 | Andersen | |
| 5,727,256 | A | * | 3/1998 | Rudman | 2/115 |
| 6,047,404 | A | * | 4/2000 | Blanks, I | 2/69 |
| 6,145,551 | A | * | 11/2000 | Jayaraman et al. | 139/387 R |
| 6,182,288 | B1 | | 2/2001 | Kibbee | |
| 6,263,510 | B1 | | 7/2001 | Bay et al. | |
| 6,298,485 | B1 | * | 10/2001 | Heller | 2/70 |
| 6,353,934 | B1 | * | 3/2002 | Tada et al. | 2/115 |
| D457,709 | S | * | 5/2002 | Davis | D2/717 |
| 6,389,600 | B1 | * | 5/2002 | Di Maio | 2/121 |
| D491,713 | S | * | 6/2004 | Wilson, II | D2/849 |
| 2004/0016041 | A1 | | 1/2004 | Uno et al. | |
| 2004/0083529 | A1 | * | 5/2004 | Tate | 2/115 |
| 2004/0235581 | A1 | | 11/2004 | Citron et al. | |
| 2005/0022290 | A1 | * | 2/2005 | Neaman | 2/271 |
| 2006/0218693 | A1 | * | 10/2006 | Sinohui | 2/115 |

FOREIGN PATENT DOCUMENTS

| | | | | |
|---|---|---|---|---|
| JP | 2000239906 | A | * | 9/2000 |
| JP | 2001040515 | A | * | 2/2001 |
| JP | 2004052119 | A | * | 2/2004 |
| WO | WO 9700026 | A1 | * | 1/1997 |

OTHER PUBLICATIONS

Uniforms Express; http://web.archive.org/web/20031005025745; as of Oct. 5, 2003.*

Baseball Vendor; Baseball Uniforms-2007 Central Baseball Line; http://www.baseballvendor.com/centralbase.htm; as of Dec. 14, 2006; p. 1-16.*

Baseball Vendor; Baseball Uniforms-2004 Central Line; http://webarchive.org/web/20040208001144/http://www.baseballvendor.com/centralbase.htm; as of Feb. 8, 2004; p. 1-7.* http://www.bartleby.com/61/43/P0654300.html; The American Heritage Dictionary of the English Language: Fourth Edition. 2000.; "pullover"; p. 1 of 1.* http://dictionary.reference.com/browse/hem; Dictionary.com Unabridges (v 1.1); "hem"; p. 1 of 1.*

Infant Clothes—Pink Strawberries Bodysuit Dress Set—3 Pcs; http://www.infashionkids.com/infant-clothes---pink-strawberries-bodysuit-dress-set---3-pcs.html: by In Fashion Kids, Inc. of Hillsborough, NJ published on or before Jun. 6, 2004.

* cited by examiner

SPORTS GARMENT

FIELD OF THE INVENTION

This invention relates generally to sports garments, and, more particularly, to a sports shirt for use with individuals such as golfers.

BACKGROUND OF THE INVENTION

While many various types of sports wear are presently available, one of the most common forms of sports wear is the golf shirt also known as a polo shirt or tennis shirt. A golf shirt typically is defined as a pullover sport shirt of preferably knitted cotton, or other similar material, generally having short sleeves and designed for comfort and casual wear.

The golf shirt may be made in several colors and patterns. Wide or narrow horizontal stripes are common, as are solid color shirts. Due to the outdoor nature of the sport they are associated with, the shirts are often in colors associated with nature, such as brown, dark blue, green, and orange, however, the shirts are not limited to these colors. Golf shirt fabrics can be manufactured from a fabric weight with little more weight than T-shirt fabric to fabrics that are quite thick and substantial for heavy wear.

As is implied by its various names, golf, polo, and tennis players wear the golf shirt. This style is also worn by others associated with sports by work, such as athletic coaches, caddies, golf professionals, and sports announcers. It is also a favored shirt for those working outside, such as groundskeepers and construction workers due to its ruggedness and support during physical activities. During the 1990's, the golf shirt became a de-facto standard of informal business attire for the high tech industry.

Although the golf shirt has become a very popular form of attire, the shirt has changed very little since it was originally designed. Some acknowledge that the original design can be traced to a 1929 design by tennis player Rene Lacoste who wanted a thick pique collar that one would wear turned up in order to block the sun from one's neck. However, over the years the shirt has changed very little from its original design.

While generally fit for its intended purpose, the golf shirt in its present form does have its drawbacks. For one, the shirt 20 (FIG. 1) which when used in sports is generally intended to be tucked into pants 22, such as shorts or slacks, but the shirt 20 has a tendency to pull out of the pants when the wearer is using large arm movements or twisting one's body such as in a golf swing. This problem also occurs with wearers that have a body type with a long back. One solution to this problem to prevent full removal of the shirt 20 from the pants 22 has been to cut the golf shirt's cloth so that the fabric in back forms a tail that hangs a few centimeters lower than in the front. This solution, while helping to avoid the full removal of the shirt from the pants, does not avoid fabric removed from the pants to form folds 24 or bunch-up and pullout along the waistline of the wearer above the belt line of the pants 22. This can cause the wearer to take on a disheveled or unkempt appearance.

In addition, the nature of the shirt fabric, designed for comfort and casual wear, takes on a form fitting appearance that outlines the body of the wearer. While adequate for those individuals in fit or good athletic shape, the shirt can have a negative effect on the appearance of individuals 26 (FIG. 2) with excess weight in the abdominal region 28. In such instances the shirt actually can accentuate or draw attention to one's weight or excess girth in this region.

Thus, the need exists for a way to provide a golf shirt that retains all of the design benefits for comfort and casual wear while correcting the problems with appearance that have been identified above.

SUMMARY OF THE INVENTION

A sports garment including a pullover shirt having inner and outer lower layers. The inner lower layer is almost always worn tucked into pants to provide comfort and support to the wearer. The outer lower layer may be worn outside of the pants to provide the wearer with a neat and trim appearance.

More particularly, the pullover shirt includes a T-shaped shirt having a collar and a slit below the collar. The inner and outer layers are attached or formed below the slit and each have a separate bottom hem.

The bottom of the outer layer includes a waistband.

BRIEF DESCRIPTION OF THE DRAWINGS

Other aspects, advantages and novel features of the invention will become more apparent from the following detailed description of the invention when considered in conjunction with the accompanying drawings wherein.

DETAILED DESCRIPTION

Figure 1:
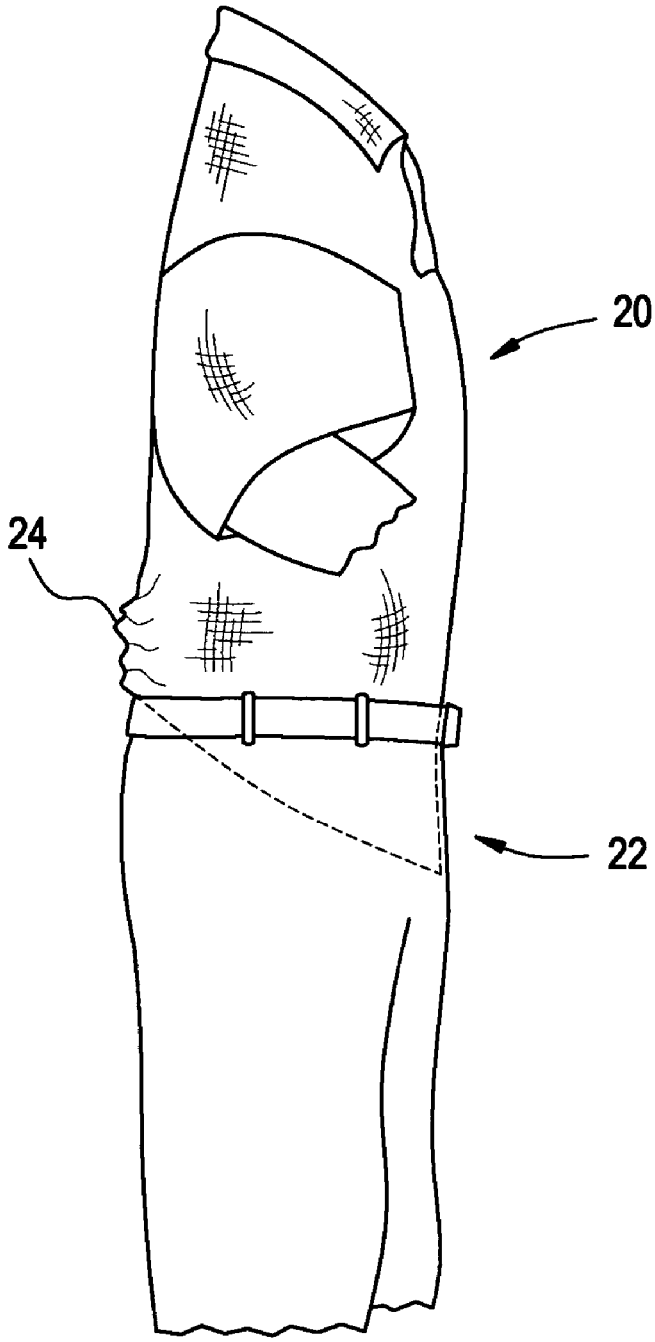
FIG. 1 PRIOR ART
FIG. 1 is a side view of an individual wearing a sports shirt according to the prior art.
Figure 2:
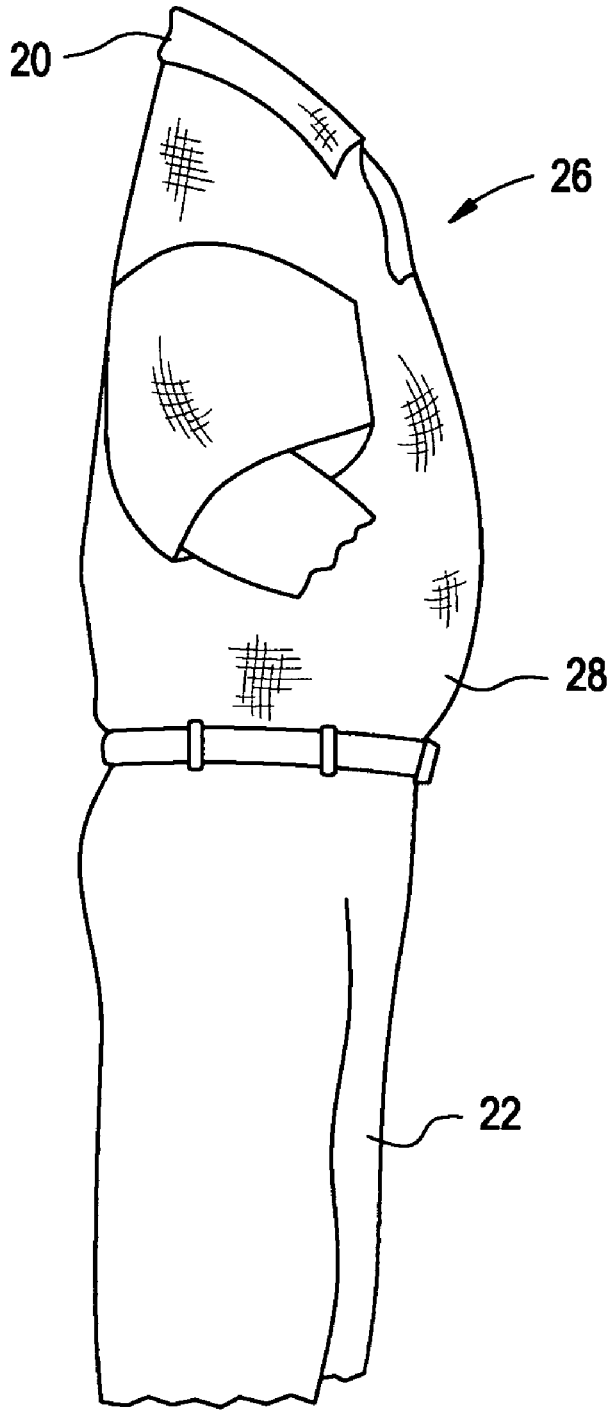
FIG. 2 PRIOR ART
FIG. 2 is an alternate side view of an individual wearing a sports shirt according to the prior art.
Figure 3:
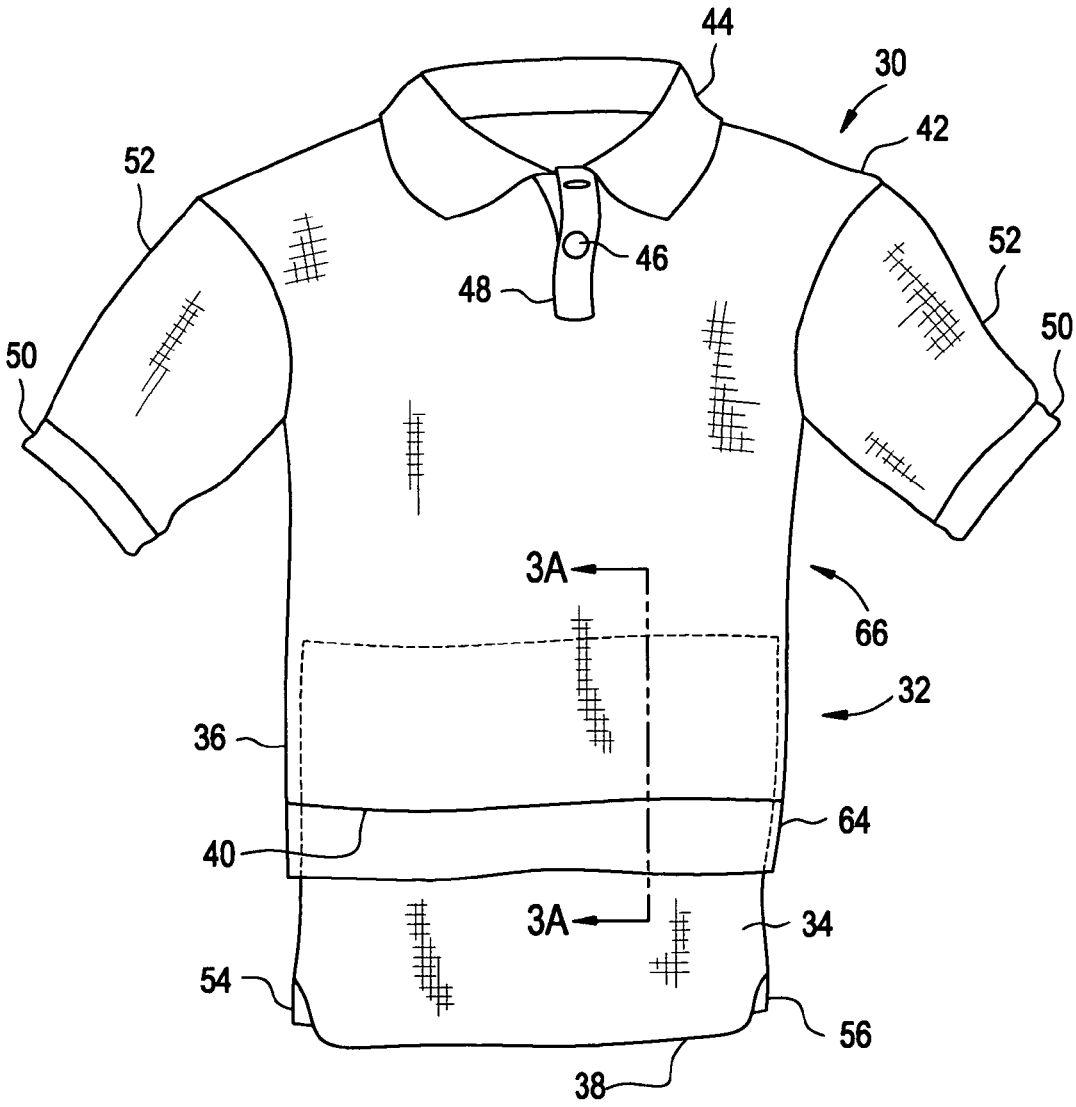
FIG. 3 is a front plan view of a sports shirt according to the present invention.

With reference to the drawings for purposes of illustration, a sports shirt 30 (FIG. 3) designed for comfort and casual wear is advantageously outfitted with a lower portion 32 of the shirt having two layers of material 34 and 36 that begin preferably in the mid or upper abdominal region of the wearer and extend downward to terminate in separate lower hems or borders 38 and 40. An inner layer 34 is designed to be tucked within the pants (not shown) of the wearer while an outer layer 36 is designed to be worn outside of the pants. The effect of the two layers 34 and 36 is that the inner layer 34 functions in a conventional manner to provide the wearer with comfort and support while the outer layer 36 overlies the shirt's inner layer 34 and wearer's pants at the waistline and functions to maintain a neat and trim appearance.

An embodiment of a sports shirt 30 incorporating the present invention adapted for a golf shirt includes a generally T-shaped shirt 42 with a neck lining having a collar 44, possibly, but without limitation, two or three buttons 46 down a slit 48 below the collar 44, ribbed cuffs or a hem 50 in the sleeves 52 and an optional pocket (not shown). The term "neck lining" as used herein is synonymous with the term "neckline". It should be noted that shirts of this type may be either long or short sleeve shirts of varying sleeve length. Also, the neck lining may include a crew neck. Common fabrics for these types of shirts include, but without limitation, pique cotton, jersey cotton, pima cotton or polyester blends.

The inner layer of fabric may further incorporate sports shirt design options including two small slits 54 and 56 on the bottom of the shirt seam on either side or having the fabric in back of the inner layer form a tail (not shown) that hangs a few centimeters lower than in the fabric in the front of the inner layer.

The outer layer 36 of fabric preferably terminates in a waist line seam 62 that connects the outer layer 36 to a waist-band 64 that is elastic or ribbed to prevent sagging of the fabric and holds the lower portion of the outer layer 36 of the shirt snuggly and comfortably about the wearer's waistline. It should be noted that the present invention is not limited to an elastic or ribbed waist-band and other means for holding the lower outer layer of the shirt snuggly and comfortably about the wearer's waistline may be used, such as, without limitation, a draw string or elastic band of fabric.

Figure 3A:
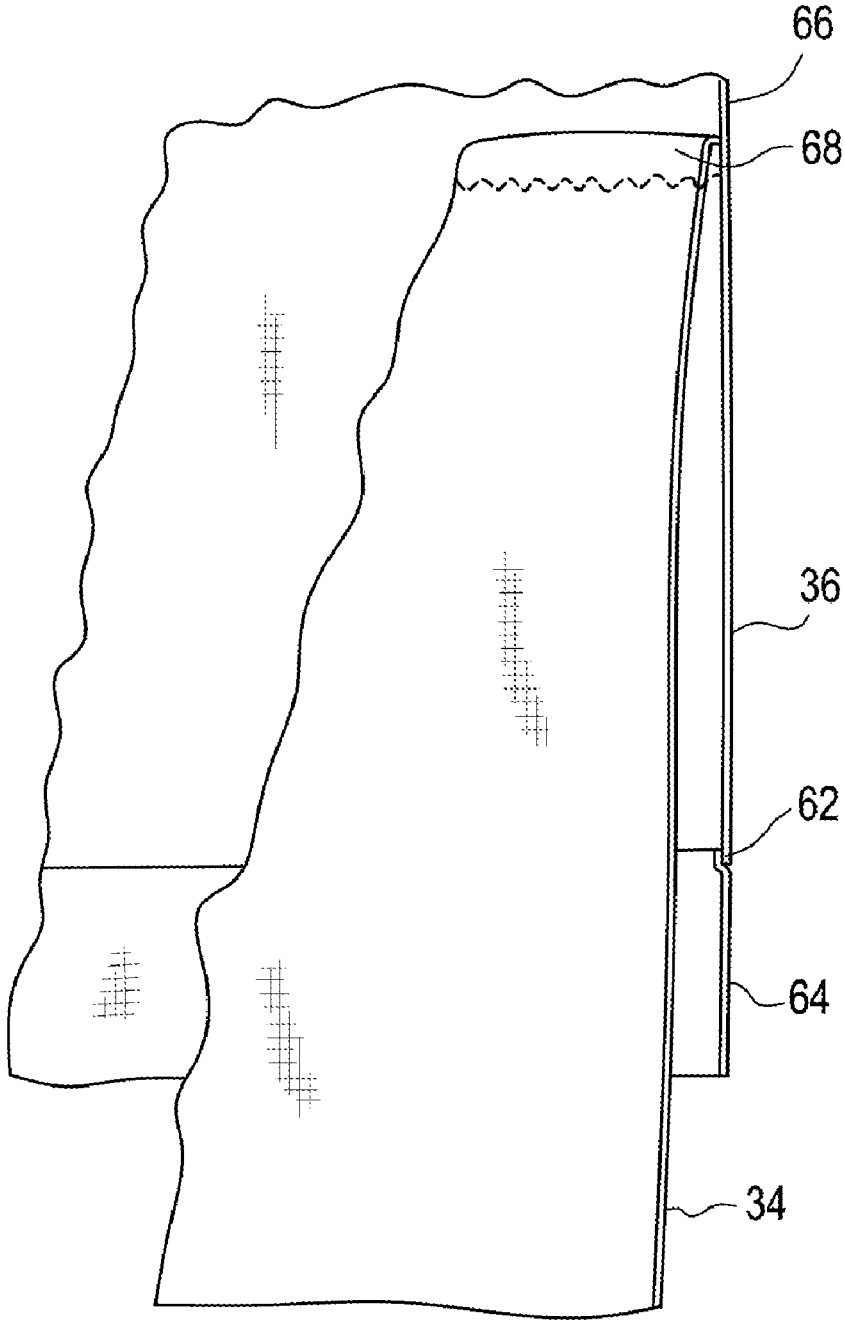
FIG. 3A is a partial cut-away view of the shirt of FIG. 3 taken along line 3A-3A.

The connection of the upper portion 66 (FIGS. 3 and 3A) of the shirt to the lower inner and outer layers 34 and 36 is by any conventional garment manufacturing means wherein the upper portion maybe formed integrally with the lower layers such that the fabric is woven to split into two separate layers or manufactured as a 2-ply or more thickness shirt such that layers of fabric can be formed to split apart and terminate as an inner and outer layer 34 and 36. Additionally, one or both of the lower layers may be attached to the upper portion of the shirt. The attachment means 68 is preferably by stitching, but may also include, but without limitation, attachment by a zipper, hook and loop material or adhesion. In addition the type and weight of the fabric used may vary along with the patterns used in the fabric. In other words, the way the shirt is manufactured with an upper layer and two lower layers may vary according to the needs and fashion design needs of the manufacturer. Thus, for example if the outer layer 36 is attached by stitching to an upper portion and inner layer 34 formed integrally, it may be desirable to place the seam connecting the outer layer 36 to the shirt 30 along a dark horizontal band formed in the fabric design to mask the connecting seam from view. Those skilled in the art of garment manufacture will appreciate that many of these types of techniques to mask the appearance of the attachment of the lower layers 34 and 36 of the shirt may be used in the manufacture of this shirt without detracting from the spirit of the invention.

Figure 4A:
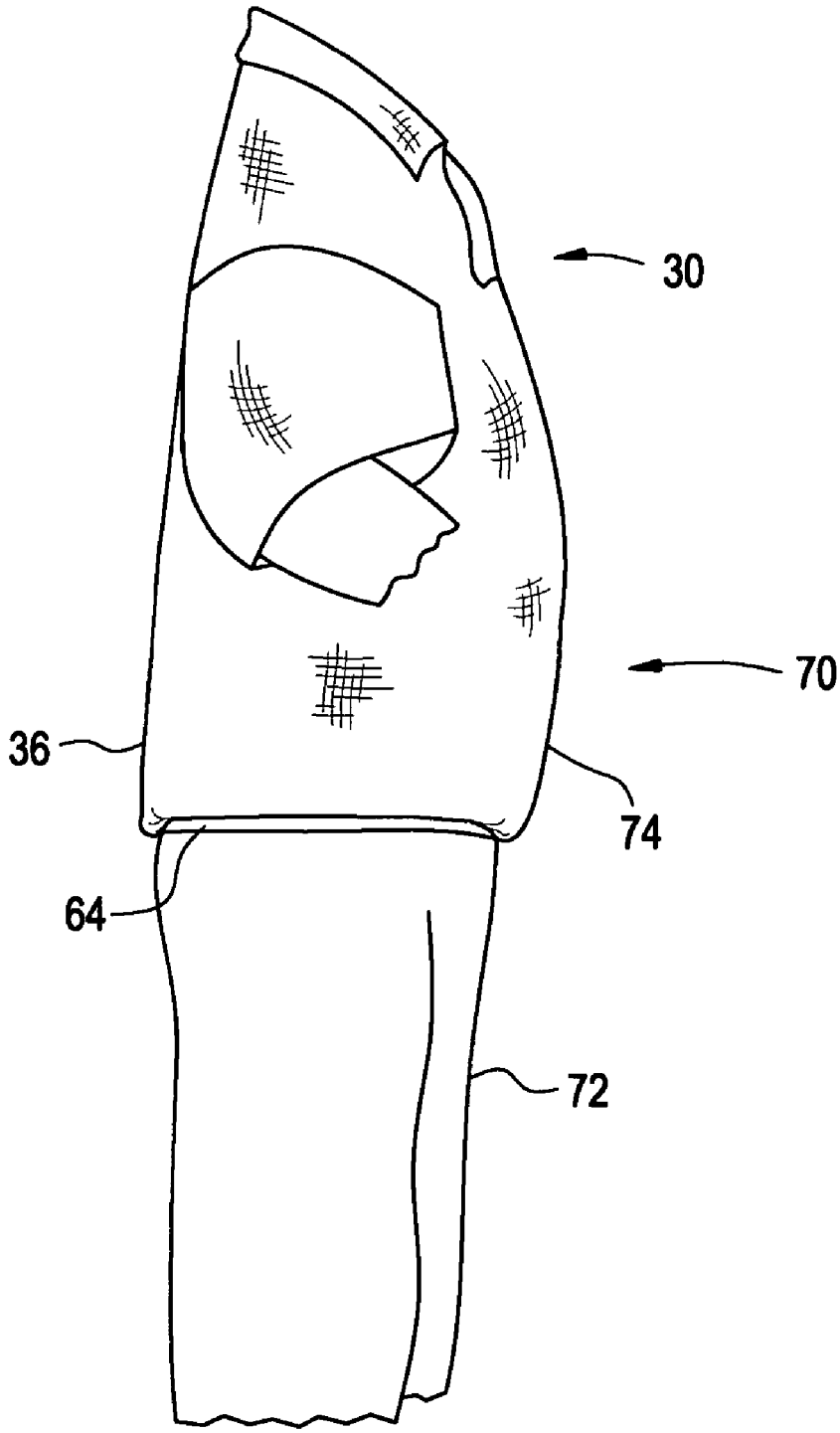
FIGS. 4A and 4B are side views of an individual wearing a sports shirt according to the present invention.
Figure 4B:
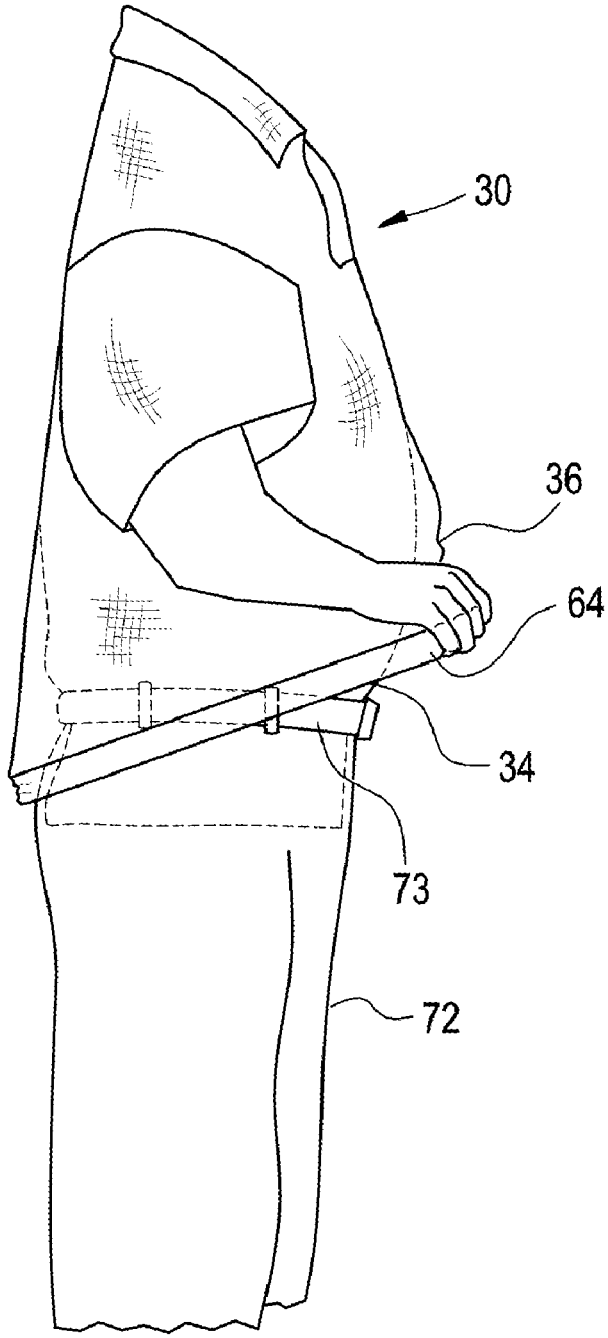

With reference to FIGS. 4A and 4B where reference to like reference numerals refer to like structure in the previous figures, a sports shirt 30 according to the invention is on an individual having excess weight in the abdominal region 70. The inner layer 34, illustrated with hidden lines, is tucked into the wearer's pants 72 optionally supported by a belt 73 and performs its function of providing comfort and support to the individual by conforming to the physical outline of the wearer. The outer layer 36 hangs over the waistline and pants 72 of the individual. The waistband 64 can be bloused underneath the outer layer to provide an outer contour line 74 for the wearer that de-emphasizes the outline of the wearer's excess girth or weight in the abdominal region 70. Thereby, the individual achieves a more desirable neat and trim appearance. It should be noted that the wearing of the waistband 64 in a bloused or non-bloused position is not required and may be dictated by factors such as fashion trends, the material of the shirt or preference of the wearer.

Figure 5A:
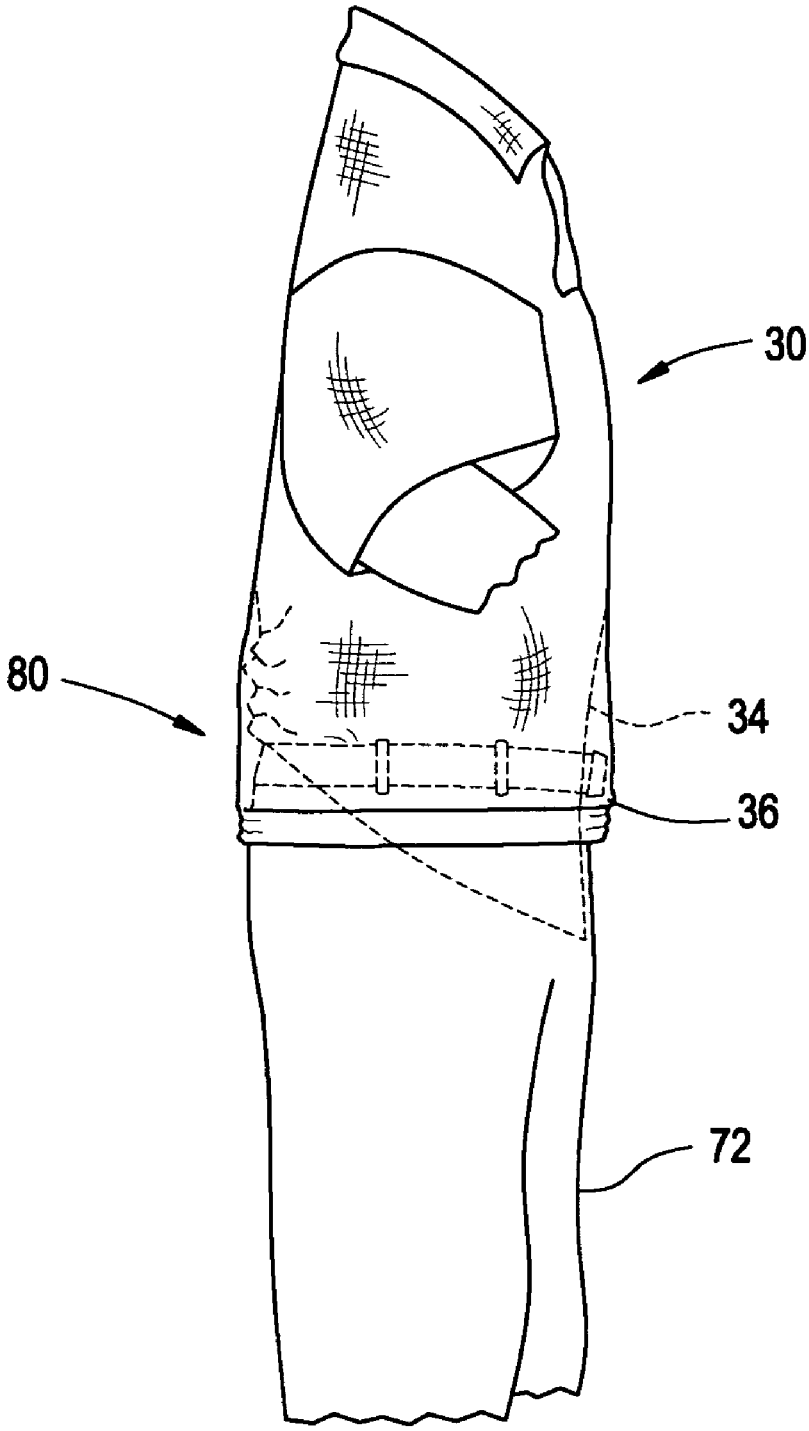
FIGS. 5A and 5B are alternate side views of an individual wearing a sports shirt according to the present invention.
Figure 5B:
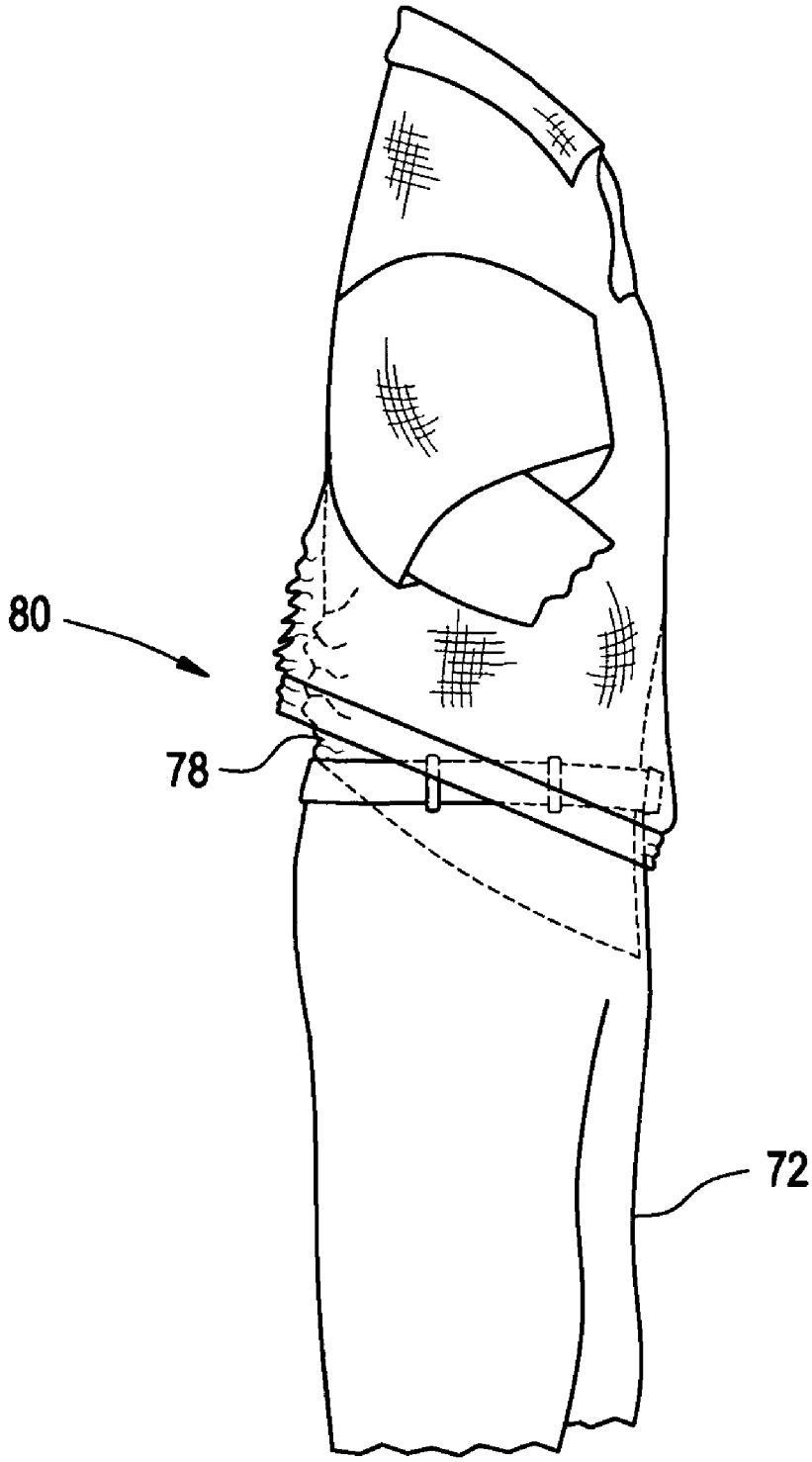

With reference to FIGS. 5A and 5B where reference to like reference numerals refer to like structure in the previous figures, a sports shirt 30 according to the present invention is on an individual having exercised such that fabric from the inner layer 34 of fabric has become withdrawn above the belt line to form folds of fabric 78 from the pants 72 in a lower region 80. The folds of fabric 78 in the lower region are hidden from the view of others by the outer layer 36 of material. Thus, even after exercise that causes withdrawal of the shirt 30 from the pants 72, for example after a round of golf, the individual wearing the shirt achieves a more desirable neat and trim appearance.

It will be appreciated by those skilled in the art of sports wear that keeping the upper portion of the shirt as a single layer, the wearer does not retain heat as might be expected from wearing a sweater or a vest over such a shirt. It should be noted here that reference to the shirt as a single layer does not imply that the shirt is limited to a single ply material, but rather is used to distinguish between the upper portion of the shirt from the lower portion with two layers having separate lower hems.

Figure 6A:
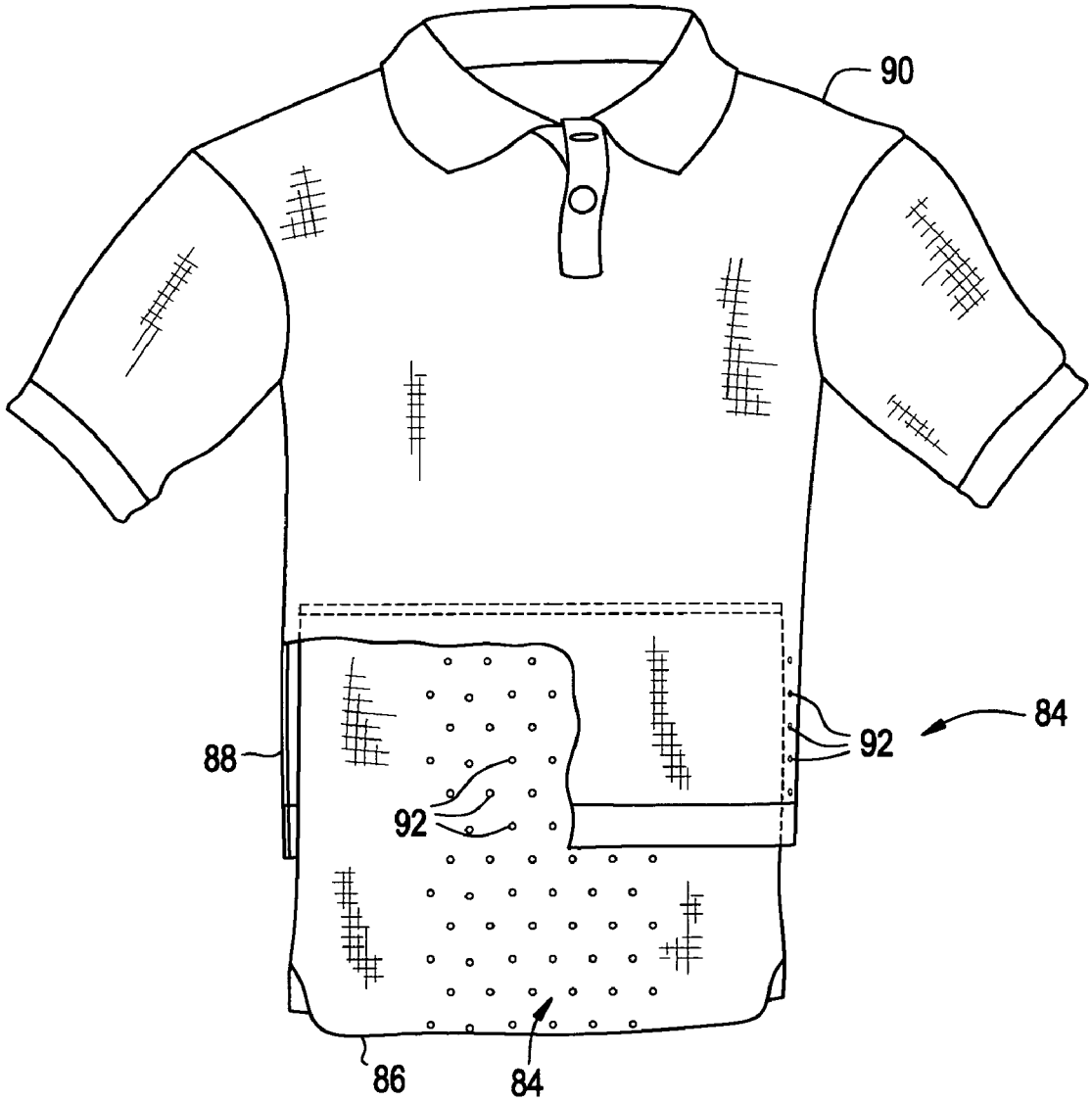
FIG. 6A is a front plan view of an alternate sports shirt according to the present invention.
Figure 6B:
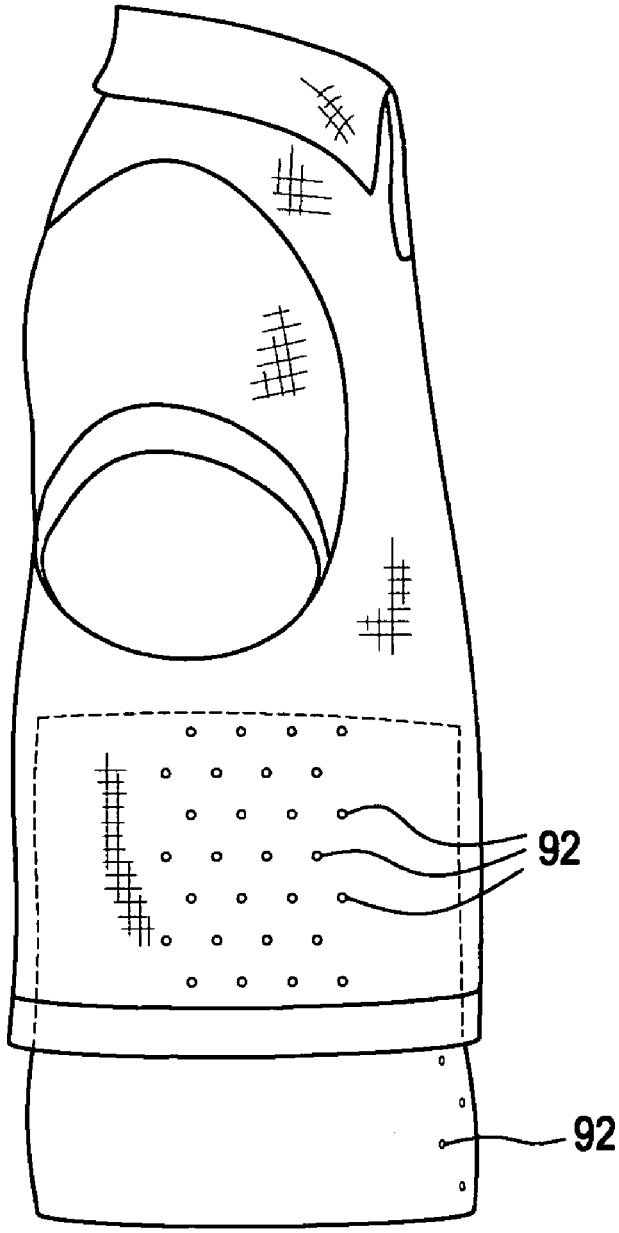
FIG. 6B is a side plan view of the alternate sports shirt of FIG. 6A.

An alternate embodiment of the present invention, with reference to FIGS. 6A and 6B, includes ventilation means 84 between the lower layers 86 and 88 of the shirt 90. As presently envisioned, the ventilation means 84 are provided in the form of small vents 92 located in the front and back of the inner layer 86 and near the side seams of the outer layer 88. It should be noted that the vent 92 may be manufactured in the form of small slits in the fabric material or even a defining region of fabric material that is less dense or with a fine mesh that defines small vents for the passage of air. Also, vents 92 may be opened or closed by any conventional means such as zippers, buttons, snaps or hook and loop material. Furthermore heat and/or sweat dispersing fabric in the inner layer 86 may be used in combination with the vents 92 in shirt 90.

It should be further understood that these presently preferred embodiments were not arrived at without experimentation. Earlier designs were considered before the presently preferred embodiments were discovered.

Figure 7:
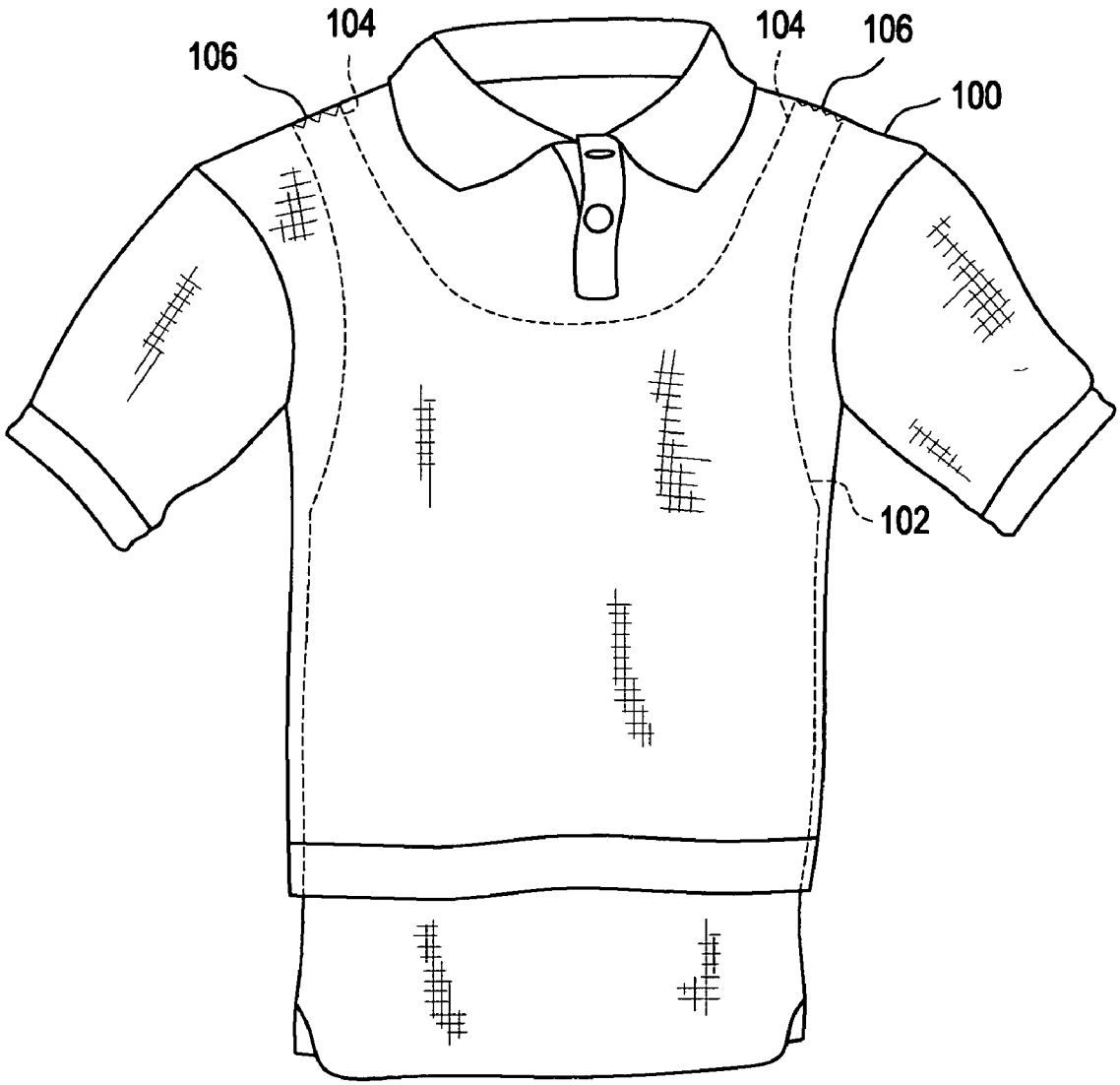
FIG. 7 is a front plan view of another alternate sports shirt according to the present invention.

A first experimental design, with reference to FIG. 7, is incorporated in a sport shirt 100 in combination with a tank top or sleeveless under-shirt 102 in which the shoulder portion 104 of the under-shirt 102 was attached by stitching or other suitable attachment means to the sports shirt 100 at the shoulders 106. However the attachment of an under-shirt 102 did not help the sport shirt 100 stay tucked into pants (not shown).

Figure 8:
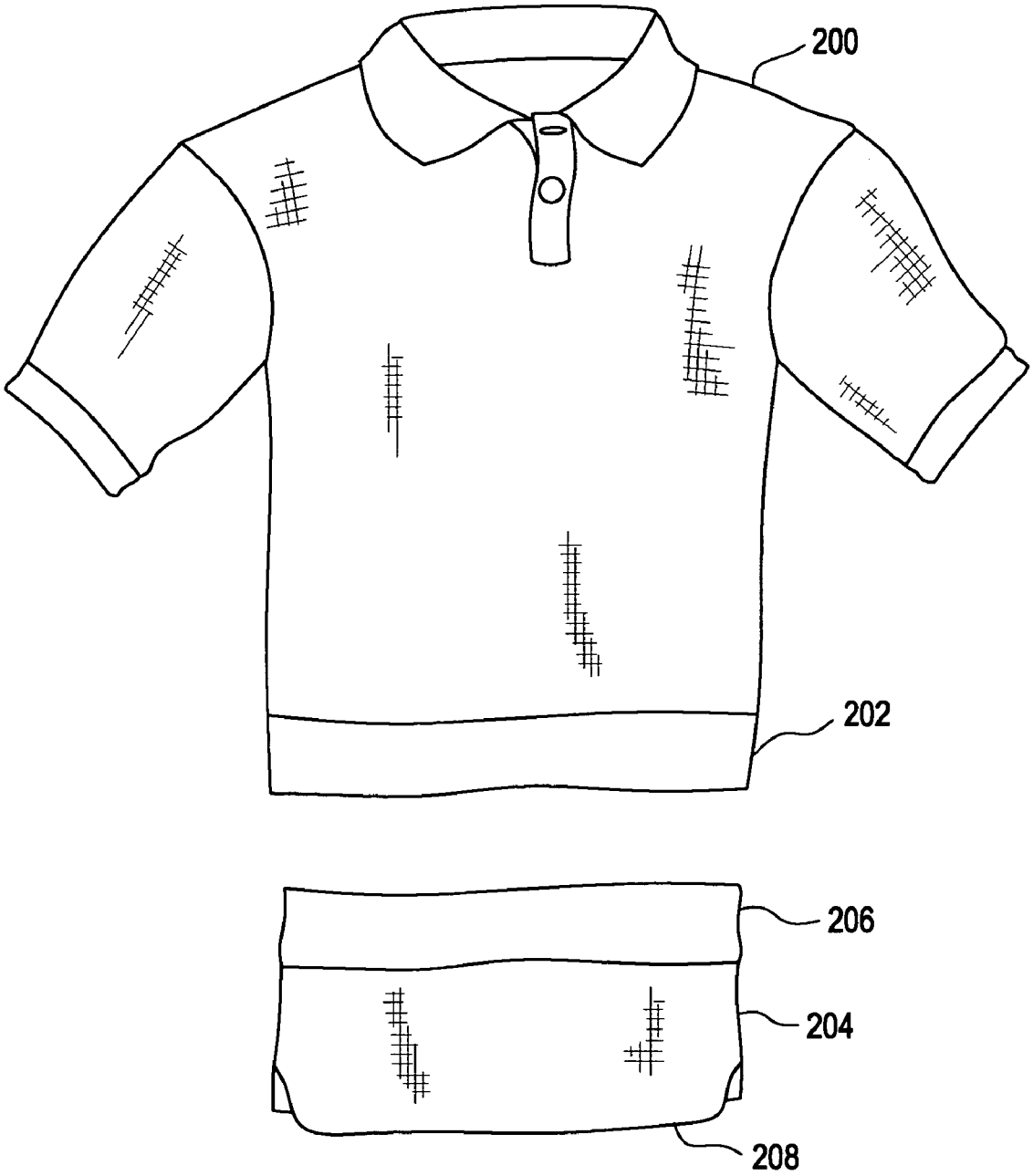
FIG. 8 is a front plan view of yet another alternate sports shirt according to the present invention.

A second experimental design (FIG. 8) incorporated a sports shirt 200 terminating with a ribbed waistband 202. This model alone was found to solve some of the problems with existing sport shirts such as becoming untucked and providing a more neat and trim appearance; however, the some of the features of comfort and support found in conventional sports shirts were absent. For example, not having the shirt 200 tucked into the pants (not shown) allowed for the waistline of the pants and more particularly a belt (not shown) supporting the pants to potentially chaff against the waistline of the wearer.

A solution to this problem was found in a modification to this design by providing a second, but separate, piece of material 204 having a ribbed waistband 206 at the top and a conventional sports shirt hem 208 at the bottom. This second piece of material 204, functioning as an undergarment sash or cummerbund, (hereinafter referred to as a cummerbund) was made of matching fabric to the shirt 200 and could be worn tucked into the pants (not shown). If the sports shirt 200 were to pull up the matching cummerbund 204 would give the appearance that the shirt 200 was tucked into the pants. However, it was still found that the shirt 200 did not provide the same level of comfort and support found when the sport shirt was tucked into the pants. Finally, the determination was made to remove the waistband 206 to the cummerbund 204 and the cummerbund 204 was attached directly to the sports shirt 200 in the mid to upper abdominal area of the shirt. It was found this combined design (FIG. 3) retained the comfort and support features of a traditional sports shirt while providing the added features of a trim and neat appearance.

While this invention has been described for use with a sport shirt, and more particularly a golf shirt, it should be noted that the benefits of this design may be incorporated into other forms of casual wear such as, but without limitation, sweat shirts.

Although the invention has been described in terms of exemplary embodiments, it is not limited thereto. Rather, the appended claims should be construed broadly, to include other variants and embodiments of the invention, which may be made by those skilled in the art without departing from the scope and range of equivalents of the invention.

What is claimed is:

1. A sports garment comprising:

a pullover shirt having a neckline selected from the group consisting of a collar and crew neck;

said shirt having a first lower layer including a front and back portion;

said shirt having a second lower layer including a front and back portion;

wherein said first lower layer is an inner layer and said second lower layer is an outer layer;

said second lower layer includes a waistband; and said waistband is attached to a lower most portion of said second lower layer by stitching to form a seam; and said waistband is selected from the group consisting of ribbed fabric, a drawstring and elastic fabric.

2. The garment of claim 1 wherein said first layer is worn tucked into pants.

3. The garment of claim 2 wherein said second layer is worn outside of said pants.

4. The garment of claim 1 wherein a seamless attachment of said shirt to at least one lower layer is selected from the group consisting of (a) said shirt and said first lower layer, (b) said shirt and said second lower layer and (c) said shirt and said first and second lower layers.

5. The garment of claim 1 wherein a seamed attachment of said shirt to at least one lower layer includes attachment means selected from the group consisting of a zipper, hook and loop material, stitching, adhesion, and any combination thereof.

6. The garment of claim 1 wherein said shirt is selected from the group consisting of a golf shirt and a sweatshirt.

7. The sports shirt of claim 1 wherein said inner layer front and back fabric is attached at at least one side seam.

8. The sports shirt of claim 7 wherein said inner layer includes at least one small slit on a bottom of said at least one side seam.

9. The sports shirt of claim 8 wherein said inner and outer layers have air vents.

10. The sports shirt of claim 7 wherein said inner layer includes a tail in said back fabric such that said back fabric hangs a few centimeters lower than said front fabric.

11. The sports shirt of claim 1 where said shirt divides into inner and outer layers in a region of said shirt covering a mid to upper abdominal region of a wearer.

12. The sports shirt of claim 11 wherein said inner layer is worn tucked into pants and said outer layer is worn outside of said pants.

13. The sports shirt of claim 11 wherein a seamless attachment of said shirt to at least one lower layer is selected from the group consisting of (a) said shirt and said inner lower layer, (b) said shirt and said outer lower layer and (c) said shirt and said inner and outer lower layers.

14. The sports shirt of claim 13 wherein a seamed attachment of said shirt to at least one lower layer includes attachment means selected from the group consisting of a zipper, hook and loop material, stitching, adhesion, and any combination thereof.

15. A sports shirt comprising:

a T-shaped shirt having a collar and a slit below said collar;

at least one button and corresponding button hole positioned along opposite sides of said slit;

sleeves;

said shirt including, below said slit, an inner layer and an outer layer having separate bottom hems;

said inner layer includes front and back fabric attached along two side seams;

said outer layer includes front and back fabric attached along two side seams and a waistband attached at a waist seam to a lower most portion of said front and back fabric;

said waistband is selected from the group consisting of ribbed fabric, a drawstring and elastic fabric; and said shirt divides into inner and outer layers in a region of said shirt covering a mid to upper abdominal region of a wearer;

such that said inner layer functions to provide said wearer with comfort and support and said outer layer functions to maintain a neat and trim appearance.

* * * * *